US010022776B2

(12) United States Patent
Lidgard

(10) Patent No.: US 10,022,776 B2
(45) Date of Patent: Jul. 17, 2018

(54) PANEL FORMING METHOD AND APPARATUS

(71) Applicant: JAGUAR LAND ROVER LIMITED, Warwickshire (GB)

(72) Inventor: Brian Lidgard, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 350 days.

(21) Appl. No.: 14/430,260

(22) PCT Filed: Sep. 26, 2013

(86) PCT No.: PCT/EP2013/070105

§ 371 (c)(1),
(2) Date: Mar. 23, 2015

(87) PCT Pub. No.: WO2014/049070

PCT Pub. Date: Apr. 3, 2014

(65) Prior Publication Data

US 2015/0217360 A1 Aug. 6, 2015

(30) Foreign Application Priority Data

Sep. 26, 2012 (GB) ..... 1217221.9

(51) Int. Cl.
*B21D 53/88* (2006.01)
*B21D 22/20* (2006.01)
*B21D 22/22* (2006.01)

(52) U.S. Cl.
CPC ..... *B21D 53/88* (2013.01); *B21D 22/20* (2013.01); *B21D 22/22* (2013.01)

(58) Field of Classification Search
CPC ..... B21D 22/20; B21D 22/22; B21D 24/005; B21D 22/02; B21D 53/88; B21D 5/00;
(Continued)

(56) References Cited

U.S. PATENT DOCUMENTS 4,061,098 A 12/1977 Horie et al.
5,685,189 A 11/1997 Nguyen et al.
(Continued)

FOREIGN PATENT DOCUMENTS

DE 19840637 A1 3/2000
EP 2198986 A1 6/2010
(Continued)

OTHER PUBLICATIONS

Definition of Grip by Merriam-Webster dictionary from <merriam-webster.com>, printed Jul. 31, 2017.*
(Continued)

*Primary Examiner* — Shelley Self
*Assistant Examiner* — Mohammad Yusuf
(74) *Attorney, Agent, or Firm* — Carlson, Gaskey & Olds

(57) ABSTRACT

Embodiments of the present invention provide a method of forming a feature line in a motor vehicle body panel. The method may comprise: in a first press operation, forming the panel into a first shapeform, the first shapeform having at least one feature line having a first radius of curvature; and in a second press operation, forming the panel into a second shapeform in which the at least one feature line has a second radius of curvature lower than the first.

19 Claims, 8 Drawing Sheets

(58) Field of Classification Search
CPC ..... B21D 11/02; B21D 22/30; B21D 24/04; B21D 25/02; B21D 22/26
See application file for complete search history.

(56) References Cited

U.S. PATENT DOCUMENTS

| | | | | |
|---|---|---|---|---|
| 5,924,188 | A * | 7/1999 | Tokunou | G11B 5/53 29/603.12 |
| 9,475,111 | B2 * | 10/2016 | Tsuchiya | B21D 22/02 |
| 2010/0186475 | A1 | 7/2010 | Hirotani | |
| 2011/0165431 | A1 * | 7/2011 | Inoue | B21D 22/02 428/599 |
| 2012/0279273 | A1 * | 11/2012 | Tsuchiya | B21D 22/02 72/358 |
| 2013/0104619 | A1 | 5/2013 | Inoue et al. | |

FOREIGN PATENT DOCUMENTS

| | | | |
|---|---|---|---|
| EP | 2208551 | A2 | 7/2010 |
| EP | 2329897 | A1 | 6/2011 |
| GB | 1577083 | | 10/1980 |
| GB | 2455039 | A | 6/2009 |

OTHER PUBLICATIONS

Combined Search and Examination Report under Sections 17 and 18(3) for Application No. GB1317114.5 dated Mar. 10, 2014.
Combined Search and Examination Report under Sections 17 and 18(3) for Application No. GB1217221.9 dated Jan. 15, 2013.
International Search Report for International application No. PCT/EP2013/070105 dated Nov. 21, 2013.

* cited by examiner

PANEL FORMING METHOD AND APPARATUS

TECHNICAL FIELD

The present invention relates to a method of forming a panel. In particular but not exclusively the invention relates to a method of forming a panel by means of a press such as a draw die tool. Aspects of the invention relate to an apparatus, to a method, to a panel formed by the method and to a vehicle comprising a panel formed by the method.

BACKGROUND

It is known to form a sheet of metal into a variety of shapes by means of a press such as a draw die tool. An example of such a tool is shown schematically at 1 in FIG. 1.

The tool 1 is supported on a base 1B and has an upper die member 10 located vertically above a punch member 20. Opposing surfaces of the upper die member 10 and punch member 20 have complementary shapes corresponding to that of the panel to be pressed therebetween. The upper die is of female type, defining a cavity into which a sheet of metal 5 that is to be pressed may be urged by the punch member 20 in order to press the sheet 5 into the desired shape.

The sheet 5 is arranged to be supported on a blank holder 30 that substantially surrounds the punch member 20. The tool 1 is arranged such that the upper die member 10 may be lowered towards the punch member 20 from the position shown in FIG. 1 so that the sheet of material 5 is gripped between the upper die member 10 and the blank holder 30. The upper die member 10 is then pressed further downwards, towards the punch member 20, bringing the sheet of material 5 into contact with the punch member 20. The sheet 5 becomes sandwiched between the upper die member 10 and punch member 20 and is forced to bend into conformity with the complementary shapes thereof as the punch member penetrates the cavity defined by the upper die member 10. The punch member 20 is forced into the cavity until the sheet 5 is drawn to a shape corresponding to that of the lower punch member 20.

In the tool 1 shown in FIG. 1, the lower punch member 20 is supported on the base 1B by resilient spring elements 22. The blank holder 30 is supported on the base 1B by dampers 32.

It is to be understood that the process described above for pressing sheets of metal is ideally suited to a mass production environment since it allows panels to be shaped in a relatively rapid, reproducible manner.

It is known that, for a given sheet of material, a minimum radius of curvature may be defined below which witness marks are formed on the surface of the sheet when the sheet is pressed between the upper die member 10 and punch member 20. Witness marks are unsightly and evidence of their presence is visible through paintwork. Panels bearing witness marks require a substantial amount of finishing following the pressing operation before they are suitable to be used in a vehicle. Witness marks or witness lines are believed to be caused by excessive stretching of the sheet.

In some arrangements, if the radius of curvature is below a certain value, an amount of shear stress induced in the panel during pressing may cause tearing of the panel.

It is desirable to be able to manufacture panels of reduced curvature in a rapid and reproducible manner suitable for incorporating into mass-produced vehicles with little or no post-pressing finishing required.

SUMMARY OF THE INVENTION

Embodiments of the invention may be understood with reference to the appended claims.

Aspects of the present invention provide an apparatus, a vehicle and a method.

According to one aspect of the invention for which protection is sought there is provided a method for forming a feature line in a motor vehicle body panel comprising:

- in a first press operation, forming the panel into a first shapeform, the first shapeform having at least one feature line having a first radius of curvature; and
- in a second press operation, forming the panel into a second shapeform in which the at least one feature line has a second radius of curvature lower than the first.

In an aspect of the invention for which protection is sought there is provided a method of forming a feature line in a motor vehicle body panel comprising:

- in a first press operation, forming the panel into a first shapeform by means of at least a first press operation first press member, the first shapeform having at least one feature line having a first radius of curvature; and
- in a second press operation, forming the panel into a second shapeform by means of at least a second press operation first press member in which the at least one feature line has a second radius of curvature lower than the first.

Embodiments of the present invention have the advantage that a motor vehicle panel may be fabricated having one or more feature lines of relatively low radius of curvature with reduced or substantially no visible witness marks. It is to be understood that by feature line is meant a fold line formed in the panel.

It is to be understood that a shape and styling of pressed motor vehicle body panels has been limited until now by the unwanted formation of witness marks when a panel is bent below a certain radius of curvature. Embodiments of the invention increase the freedom of vehicle designers in achieving shapes that may be of enhanced aerodynamic efficiency and/or aesthetic appeal.

It is to be understood that a plurality of feature lines may be formed. Two or more of the feature lines may have substantially the same radius of curvature. Alternatively, two or more of the feature lines may have different respective radii of curvature. Importantly, a radius of curvature of at least one feature line is lower following the second press operation than it is following the first press operation. That is, the second press operation causes a reduction in the value of radius of curvature of at least one feature line.

Advantageously the first press operation may comprise drawing the panel into the first shapeform by means of a first press operation first press member. Drawing the panel into the first shapeform may comprise gripping a peripheral region of the panel. The panel may be gripped so as to oppose movement of the panel as the first press member presses the panel, thereby causing a tensile stress to be induced in the panel (or causing an amount of tensile stress that is induced in the panel to be increased). Drawing of the panel takes place as the first press member is forced against the panel, that is, stretching of material forming the panel, to cause the panel to conform to the shapeform of the first press member.

Further advantageously the second press operation may comprise drawing the panel into the second shapeform by means of a second press operation first press member. Drawing the panel into the second shapeform may comprise gripping a or the peripheral region of the panel in a similar manner to the first press operation.

Gripping the peripheral region may comprise gripping a substantially continuous region around substantially the entire periphery of the panel. The peripheral region may be inboard of an outer edge of the panel along at least a portion of the peripheral region. The peripheral region may be defined by an edge of the panel along at least a portion of the peripheral region.

The first press operation may comprise pressing the panel against a first press operation second press member by means of the first press operation first press member to form the panel into the first shapeform.

The second press operation may comprise pressing the panel against a second press operation second press member by means of the second press operation first press member to form the panel into the second shapeform.

Advantageously the first press operation first press member may have a shape corresponding to that of the first shapeform.

Further advantageously the first press operation first and second press members may be of corresponding complementary shape to the first shapeform.

Advantageously the second press operation first press member may have a shape corresponding to that of the second shapeform.

Further advantageously the second press operation first and second press members may be of corresponding complementary shape to the second shapeform.

Advantageously the first press operation may comprise drawing the panel into the first shapeform by means of a first press operation first punch member. That is, the first press operation first press member may be a punch member.

Further advantageously the second press operation may comprise drawing the panel into the second shapeform by means of a second press operation first punch member. That is, the second press operation first press member may be a punch member.

Advantageously the panel comprises or is comprised by a hood or bonnet of a motor vehicle.

The method may comprise forming a plurality of feature lines in a panel.

The method may comprise forming a plurality of substantially parallel feature lines in a panel.

The method may comprise forming the feature lines along substantially opposite edges of a panel. The method may comprise forming the feature lines inboard of substantially opposite edges of the panel.

It is to be understood that forming feature lines of relatively small radius along or inboard of opposite edges of a panel is a non-trivial task. For example, forming substantially parallel feature lines of relatively small radius along opposite longitudinal edges of a vehicle bonnet has not been possible to date without introducing unsightly witness marks. Embodiments of the present invention allow such feature lines to be formed in relatively thin sheets of material such as aluminium without the formation of visible marks associated with known methods.

The method may comprise forming the feature lines inboard of substantially opposite edges of a panel.

The method may comprise forming the feature lines inboard of substantially opposite edges of the panel to define a skirt portion of a clamshell-type vehicle body panel.

The clamshell-type body panel may be a bonnet or hood of a motor vehicle, or a boot or trunk lid of a motor vehicle.

The method may comprise forming a hood or bonnet of a motor vehicle.

The method may comprise forming a bonnet or hood substantially of clamshell-type.

The one or more features lines may define a boundary between an upper, transverse lid portion of the bonnet or hood and a skirt portion depending from the upper, transverse lid portion. It is to be understood that the upper transverse lid portion is arranged to lie transversely across a vehicle centreline, optionally across substantially a whole width of a vehicle. The lid portion and skirt portion may form the clamshell bonnet or hood, the lid portion and skirt portion being formed from a single pressed panel.

Advantageously the method may comprise forming the first shapeform whereby the first radius of curvature has a value in the range from around 20 mm to around 40 mm, optionally from around 25 mm to around 40 mm, further optionally from around 25 mm to around 35 mm.

Further advantageously the method may comprise forming the second shapeform whereby the second radius of curvature has a value from around 1 mm to around 15 mm, optionally from around 5 mm to around 15 mm, further optionally from around 5 mm to around 10 mm.

The method may comprise forming the panel from a sheet of metal comprising aluminium, optionally a sheet of 6xxx series or AC-170 aluminium alloy.

Advantageously the method may comprise forming the panel from a sheet of metal having a thickness in the range from around 0.5 mm to around 5 mm, optionally from around 0.5 mm to around 3 mm, further optionally from around 1 mm to around 2 mm, still further optionally around 1.1 mm.

In an aspect of the invention for which protection is sought there is provided a motor vehicle panel formed by a method according to an aspect of the invention.

In a further aspect of the invention for which protection is sought there is provided a motor vehicle comprising a panel formed by a method according to an aspect of the invention.

In a still further aspect of the invention for which protection is sough there is provided apparatus for forming a feature line in a motor vehicle body panel comprising:

- a first press portion for performing a first press operation in which a panel is formed by means of a first press member of the first press portion into a first shapeform having at least one feature line having a first radius of curvature; and
- a second press portion for performing a second press operation in which a panel is formed by means of a first press member of the second press portion into a second shapeform in which the at least one feature line has a second radius of curvature lower than the first.

Advantageously the first member of the first press portion may be operable to draw a panel into the first shapeform and the second member of the second press portion may be operable to draw a panel into the second shapeform.

The apparatus may comprise gripping means for gripping a substantially continuous region around substantially an entire peripheral region of a panel, the first member of the first press portion being operable to draw a panel into the first shapeform and the second member of the second press portion being operable to draw a panel into the second shapeform with the gripping means gripping the substantially continuous region around substantially the entire peripheral region of a panel.

Advantageously the first member of the first press portion may have a shape corresponding to that of the first shapeform.

Further advantageously the first member of the first press portion may be operable to press a panel against a second member of the first press portion.

Still further advantageously the first and second members of the first press portion may be of corresponding complementary shape to the first shapeform.

Advantageously the first member of the second press portion may have a shape corresponding to that of the second shapeform.

Further advantageously the first member of the second press portion may be operable to press a panel against a second member of the second press portion.

Still further advantageously the first and second members of the first press portion may be of corresponding complementary shape to the second shapeform.

The first and second pairs of press members may be shaped to define a vehicle bonnet or hood.

In one aspect of the invention for which protection is sought there is provided a method of forming a feature line in a motor vehicle panel comprising: in a first press operation, pressing the panel between a first pair of press members to form a panel into a first shapeform, the first press operation comprising bending a panel to define at least one feature line having a first radius of curvature; and in a final press operation, pressing a panel between a final pair of press members to form a panel into a final shapeform, the final press operation comprising bending one or more portions of a panel defining the at least one feature line to a final radius of curvature lower than the first.

In an aspect of the invention for which protection is sought there is provided a method of forming a feature line in a motor vehicle panel comprising: in a first press operation, pressing the panel between a first pair of press members to form the panel into a first shapeform having at least one feature line having a first radius of curvature; and in a second press operation, pressing the panel between a second pair of press members to form the panel into a second shapeform in which the at least one feature line has a second radius of curvature lower than the first.

The first press operation may comprise drawing the panel by means of a first one of the first pair of press members and pressing the panel between the first pair of press members, at least the first of the first pair of press members being shaped in a manner corresponding substantially to that of the first shapeform.

Optionally the first and a second of the first pair of press members are of corresponding complementary shape.

Optionally the second press operation comprises drawing the panel by means of a first one of the second pair of press members and pressing the panel between the second pair of press members being members shaped in a manner corresponding substantially to that of the second shapeform.

The first press operation may comprise drawing the panel by means of the first of the first pair of press members whereby the panel is drawn around a substantially curved portion of said first of the first pair of press members to form in the panel at least one feature line having the first radius of curvature.

Optionally the second press operation comprises pressing the panel whereby one or more portions of the panel defining the at least one feature line are drawn by a first press member of the second pair around a substantially curved portion of the first press member of the second pair thereby to conform the at least one feature line to the second radius of curvature.

The substantially curved portion of the first of the first pair of press members may have a radius of curvature that is greater than the radius of curvature of the first of the second pair of press members, as a result of which the at least one feature line has a lower radius of curvature following the second press operation compared with that following the first press operation prior to the second press operation.

Optionally the first one of the first pair of press members comprises a punch member.

Optionally, drawing the panel by means of the first one of the first pair of press members comprises gripping the panel around a peripheral edge of a region of the panel to be formed into the second shapeform and urging the first one of the first pair of press members against the panel to cause deformation of the panel. Gripping the panel may comprise gripping the panel by clamping the panel between clamping members, one of which may be provided by the first and second press portions during the respective first and second press operations. The clamping members may be arranged to grip the panel at a peripheral edge substantially surrounding the region of the panel to be formed into the second shapeform. Following the second press operation at least a portion of the panel that was gripped between the clamping members may be removed from the panel, for example by cutting. The panel may be gripped in a substantially continuous manner around the peripheral edge, or at locations spaced apart around the peripheral edge.

The feature that a clamping pressure is applied around a peripheral edge of boundary of a region to be subject to pressing in order to form the panel into the first shapeform, and subsequently the second shapeform, has the advantage that a tensile stress may be induced in the panel during the pressing operation and the amount of plastic tensile deformation controlled by controlling the clamping pressure applied to grip the panel. The panel is therefore subject to plastic tensile deformation as well as bending into conformity with the shapeform of the first and second press members of the first and second press operations.

In some embodiments the clamping pressure may be such as to allow some slippage of the panel between the clamping members during the pressing operation. By allowing slippage, an amount of plastic deformation of the panel that takes place due to the tensile stress applied may be reduced. In some alternative embodiments, the clamping pressure may be such as substantially to prevent slippage of the panel between the clamping members.

The first press operation may comprise forming a pair of feature lines that are disposed such that a projection of at least a portion of each feature line onto a nominal flat plane disposed between the feature lines overlap one another, during a press operation portions of the panel disposed between the feature lines and on opposite sides of the nominal flat plane being subject to drawing in opposite directions within the plane of the panel.

The projections may be substantially superimposed on one another, optionally along substantially an entire length of each projection. It is to be understood that by projection is meant a projection along a direction from the feature line, the direction being normal to the nominal flat plane.

Advantageously, the pair of feature lines may be disposed substantially symmetrically about the nominal flat plane.

It is to be understood that, during the first and second press operations, as the first press member begins to apply a force to the panel, tensile stress induced in the panel between the regions where the pair of feature lines are formed or to be formed may be substantially symmetrical about the nominal flat plane.

In an aspect of the invention for which protection is sought there is provided a hood or bonnet of a motor vehicle comprising a panel fabricated according to the preceding method.

According to one aspect of the invention for which protection is sought there is provided a method for forming a feature line in a motor vehicle panel comprising:

in a first press operation, forming the panel into a first shapeform, the first shapeform having at least one feature line having a first radius of curvature; and in a second press operation, forming the panel into a second shapeform in which the at least one feature line has a second radius of curvature lower than the first.

The panel may be a body panel

In an aspect of the invention for which protection is sought there is provided a method of forming a feature line in a motor vehicle panel comprising: in a first press operation, pressing the panel between a first pair of press members to form the panel into a first shapeform having at least one feature line having a first radius of curvature; and in a second press operation, pressing the panel between a second pair of press members to form the panel into a second shapeform in which the at least one feature line has a second radius of curvature lower than the first.

Within the scope of this application it is expressly envisaged that the various aspects, embodiments, examples and alternatives set out in the preceding paragraphs, in the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

One or more embodiments of the invention will now be described, by way of example only, with reference to the accompanying figures in which.

DETAILED DESCRIPTION

Figure 1:
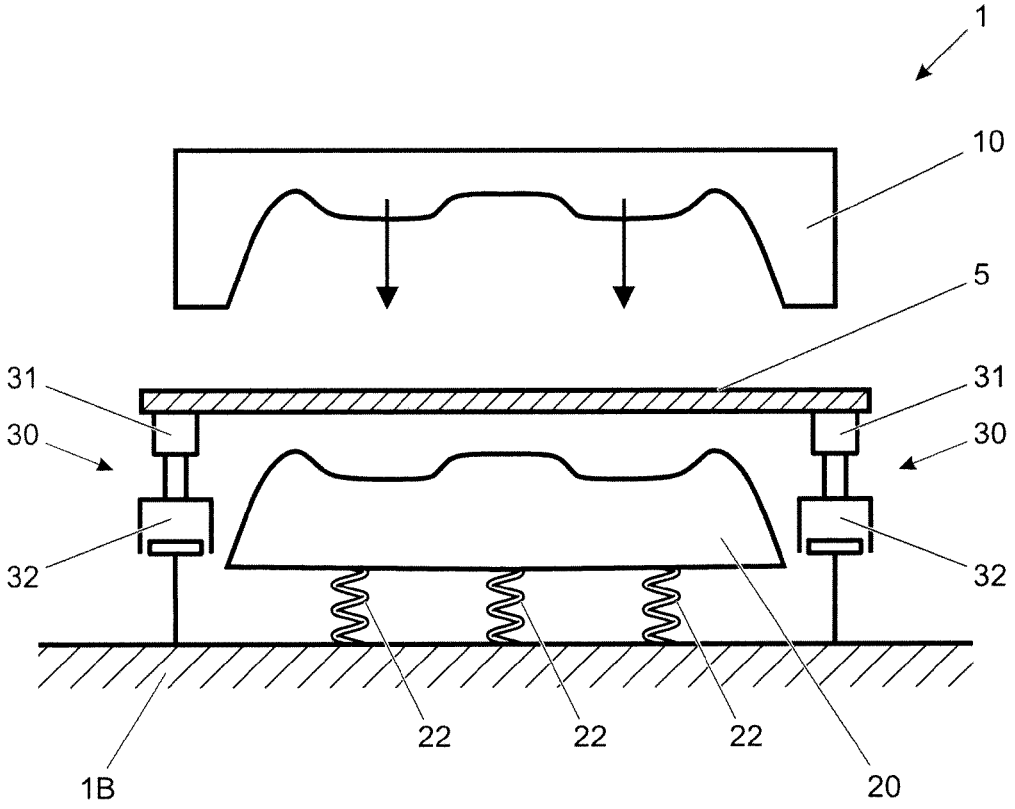
PRIOR ART FIGURE 1
FIG. 1 is a schematic illustration of a known single action draw die press.
Figure 2:
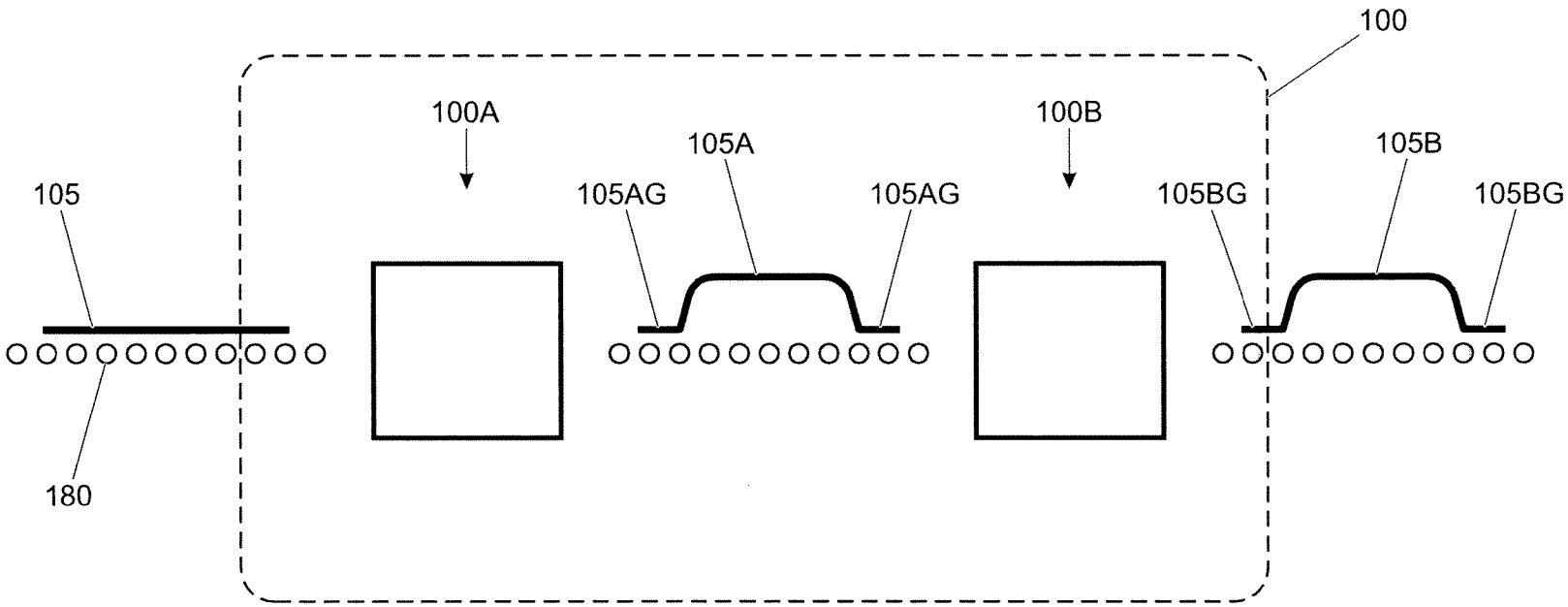
FIG. 2 is a schematic illustration of a dual single action draw die press according to an embodiment of the present invention.

FIG. 2 shows a dual single action draw die press 100 according to an embodiment of the present invention. Like features of the press 100 of FIG. 2 to the press 1 of FIG. 1 are provided with like reference signs incremented by 100.

The press 100 is configured for forming a motor vehicle bonnet or hood by a dual strike or 'restrike' process. According to the process, a substantially flat sheet 105 (or 'blank') of aluminium alloy metal from which the bonnet is to be formed is pressed (struck) twice (by first and second pressing operations) in order to form a final bonnet shapeform 105B.

The sheet 105 may be formed from any suitable metal including an alloy of two or more metals. In one example a sheet of 6xxx series aluminium alloy such as AC-170 alloy is processed by the press 100. The sheet may be of any suitable thickness. Sheet of thickness 1.1 mm for a motor vehicle hood has been found to be ideally suited to processing in a method according to an embodiment of the present invention. Other materials and other thicknesses are also useful. Other panels may also be formed.

The press 100 has two single action draw die press portions 100A, 100B. The press portions 100A, 100B will be referred to as first and second draw die press portions respectively. The press portions 100A, 100B are arranged in series such that a component processed by the first press portion 100A is subsequently processed by the second press portion 100B.

Figure 3:
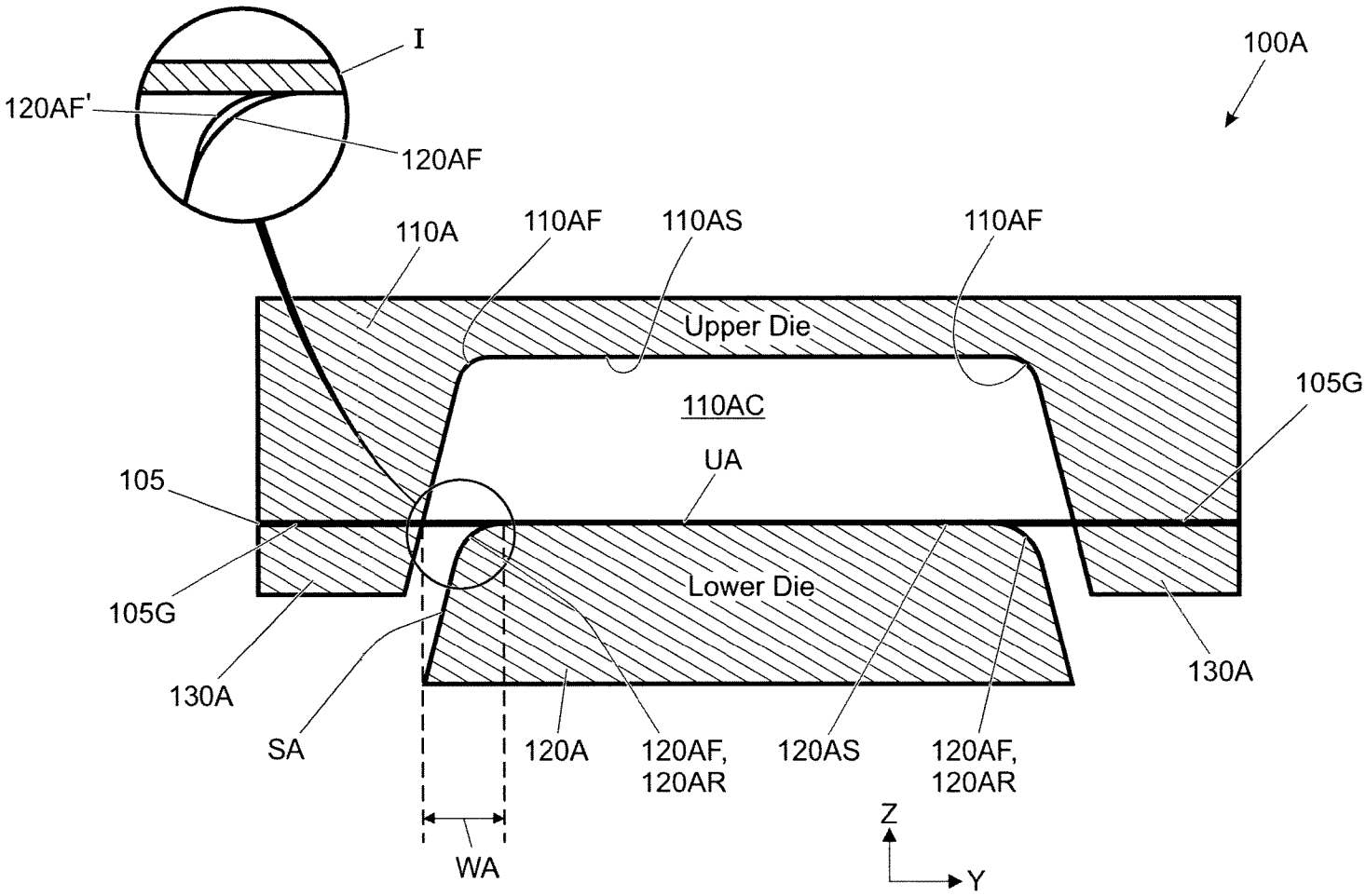
FIG. 3 are schematic illustrations of a process of forming a first shapeform of a motor vehicle bonnet using the press of FIG. 2 showing (a) apparatus with a blank sheet of material mounted in the apparatus for pressing immediately prior to the blank being deformed, (b) the apparatus of (a) after deformation has commenced, and (c) a punch member in plan view.
Figure 3:
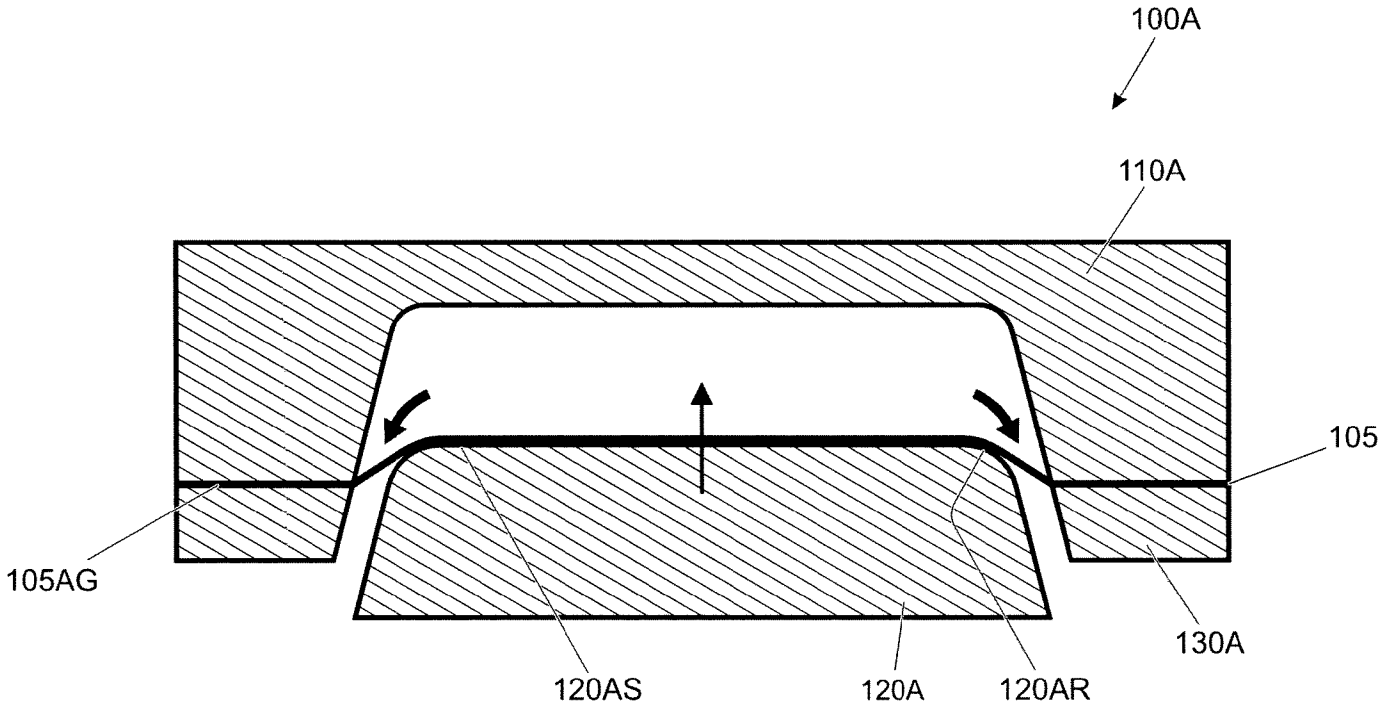
Figure 3:
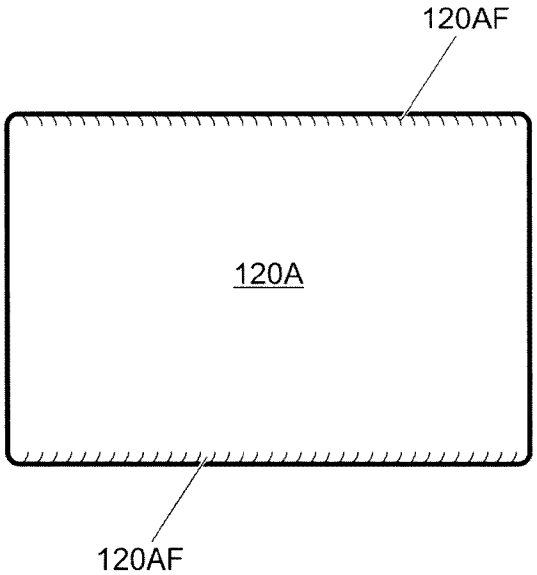

A conveyor 180 is arranged to convey the substantially flat sheet 105 to the first press portion 100A where a first press operation is performed. As shown in FIG. 3(*a*), in the first press portion 100A the sheet 105 is clamped between an upper die member 110A and a blank holder 130A. In the present embodiment, the upper die member 110A and blank holder 130A are arranged to clamp the sheet 105 between the upper die member 110A and blank holder 130A over a peripheral clamping portion 205BG that surrounds a region of the sheet that is to be subject to pressing. The upper die member 110A and blank holder 130A exert a clamping pressure sufficient to allow limited movement of the clamping portion 205BG during the pressing operation. The feature that a clamping pressure is applied along a peripheral boundary of the region to be subject to pressing has the advantage that a tensile stress may be induced in the panel 105 during the pressing operation in order to stretch the panel 105 as well as bending the panel 105 into conformity with the shapeform of the upper die member 110A and punch member 120A. In some embodiments the clamping pressure may be sufficient substantially to prevent slippage of the panel 105 between the die member 110A and holder 130A.

A lower die or punch member 120A is then urged against the sheet 105 towards the upper die member 110A such that the sheet 105 is pressed into a cavity 110AC defined by the upper die member 110A as shown in FIG. 3(*b*). The sheet 105 is drawn by the punch member 120A into the cavity, so that the sheet 105 deforms in order to conform to an outer surface 120AS of the punch member 120A. In some embodiments the punch member 120A is moved upwardly whilst in some embodiments the upper die member 110A moves downwardly. In some embodiments the upper die member 110A may move downwardly and the punch member 120A may move upwardly.

The outer surface 120AS of the punch member 120A has edges 120AF each of which defines a feature line or fold line that is to be formed in the sheet 105. The edges are characterised by a radius of curvature 120AR.

The inner surface 110AS of the upper die member 110A has a shape corresponding to that of the outer surface 120AS of the punch member 120A. Thus, corners 110AF of the upper die member 110A have a shape and position corresponding to the corners 120AF of the punch member 120A. The punch member 120A is shown in plan view in FIG. 3(*c*).

The first press portion 100A is configured to press the sheet 105 between the upper die member 110A and punch member 120A in order to force the sheet 105 to conform to the shape of the punch member 120A such that the sheet 105 forms a panel 105A having the first shapeform.

Figure 4:
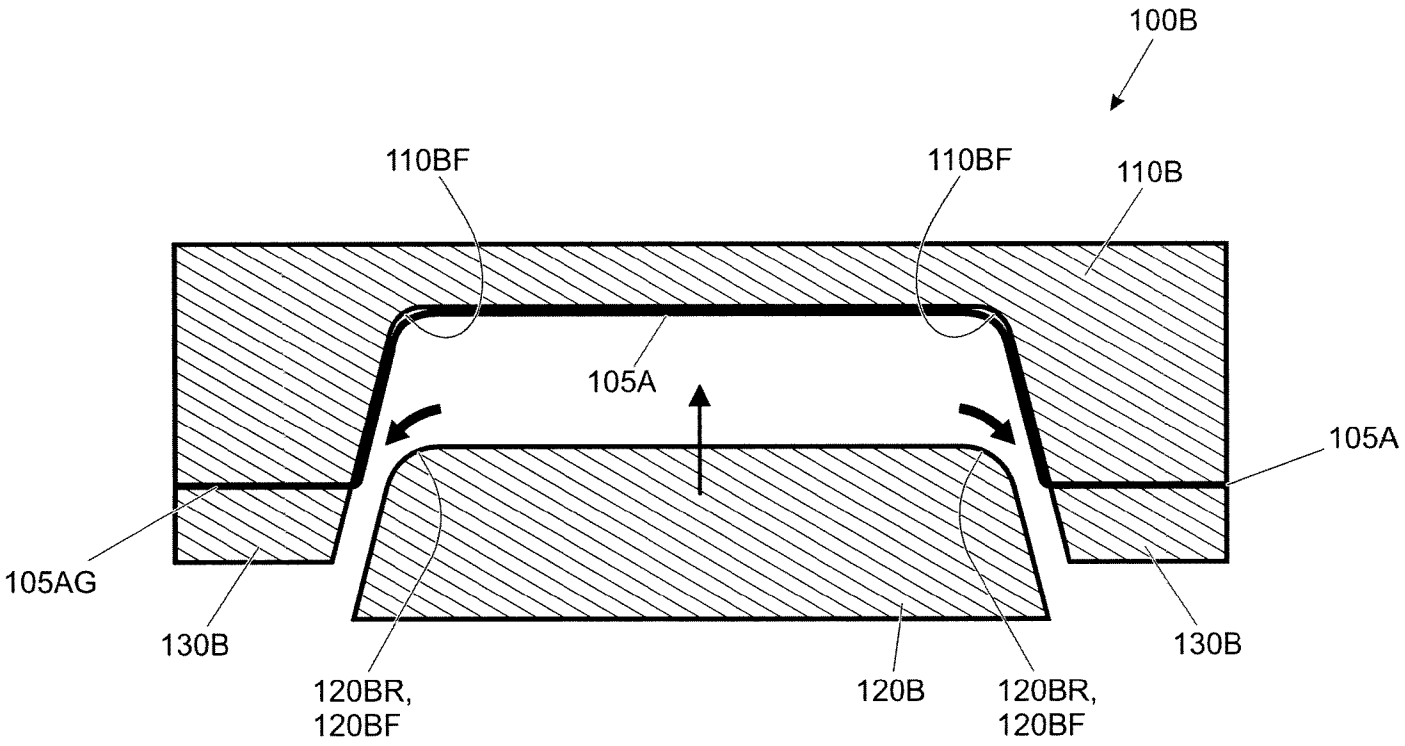
FIG. 4 is a schematic illustration of a process of forming a final shapeform of a motor vehicle bonnet using the press of FIG. 2.

After being pressed into the first shapeform the panel 105A is then conveyed to the second press portion 100B illustrated in FIG. 4 where a second press operation is performed. The second press portion 100B is of similar construction and operation to the first and like features of the second press portion to those of the first are labelled with like reference numerals suffixed letter B instead of letter A.

The second press portion 100B, like the first press portion 100A, is arranged to grip a clamping portion 105AG of the first shapeform 105A between an upper die member 110B and a holder 130B.

The upper die member 110B is substantially identical in size and shape to the upper die member 110A of the first press portion 100A except that a radius of curvature of corners 110BF defining the feature lines is smaller. The radius of curvature of the corners 110BF corresponds to that of the edges 120BF of punch member 120B, having a value 120BR. The value of the radius of curvature 120BR corresponds substantially to that of the final shapeform 105B. It is to be understood that the final shapeform 105B may not correspond precisely to that of the punch member 120B due to spring-back of material forming the panel 105B following release from the second press portion.

In the second press operation, the punch member 120B is driven towards the upper die member 110B (and/or the upper die member 110B is driven towards the punch member 120B) and the panel 105A is pressed between the punch member 120B and upper die member 110B. The portions of the panel 105A trapped between corners 110BF, 120BF of the upper die member 110B and punch member 120B, respectively, are drawn and bent to form a feature or fold line having a smaller radius of curvature 120BR by this second press operation, forming the panel 105B having a second shapeform.

Once the second press operation has been completed, any remaining portion 105BG of the panel 105B that was present between the upper die member 110B and holder 130B at the end of the second press operation is removed by cutting.

Embodiments of the present invention have the advantage that they allow feature lines to be formed in a pressed panel that are free of visible witness marks to specifications at which conventional single-press methods would introduce severe witness marks, rendering the panel unsuitable for a mass production process. Furthermore, embodiments of the present invention have the advantage that a risk that a sheet of metal becomes torn during a press operation due to excessive shear being imposed on the sheet, is reduced.

As described above, in some embodiments of the present invention an initially flat sheet or panel of material 105, which may be referred to as a blank, is bent to form a final shapeform in a two stage process. In some embodiments, in a first press operation, the panel 105 is drawn by a punch member and pressed by the punch member into a die to form a pair of feature lines in the panel of a first radius of curvature. The feature lines may be disposed symmetrically about an axis of the panel which, in the case of a bonnet or hood panel of a vehicle, may be arranged to lie parallel to and optionally coincident with a longitudinal axis of a motor vehicle. In a second press operation the panel is drawn and/or pressed to reduce the radius of curvature of the feature lines to a second radius of curvature less than the first. By performing a two-stage forming operation, the formation of witness marks in the panel may be prevented when, in contrast, if the panel were drawn and pressed to form feature lines having the second radius of curvature directly from a substantially flat sheet, unsightly witness marks would be formed.

It is believed that the mechanism by which witness mark suppression is achieved is that when the panel is initially drawn from a substantially flat condition to form feature lines having the first radius of curvature 120AR, an amount of strain induced in the material of the panel 105 that is drawn in the forming operation is less than that which would be induced if a substantially flat panel were drawn to the final radius of curvature 120BR in a single operation.

When the punch member 120A initially contacts the panel 105, an area of the panel 105 that is not in contact with the upper die 110A or punch member 120A is of width WA along a lateral (Y) axis as shown in FIG. 3(*a*). That is, a projected width of the portion of the panel 105 not in contact with upper die 110A or punch member 120 on a plane normal to the Z axis (the Z axis being normal to a plane of the panel 105 prior to pressing) is WA. Assuming to a first approximation that the portion of the panel 105 in contact with the punch member 120A experiences relatively little or no strain (e.g. due at least in part to friction between the panel 105 and punch member 120A) compared with the portion of width WA, it is believed that the portion of the material of width WA is stretched to a length corresponding to that of the side SA of the punch member 120A. That is, the portion of material of width WA is stretched to a length corresponding to that of the length of the side SA of the punch member 120A that comes into contact with the material of width WA during the first press operation.

It will be appreciated that, if the radius of curvature of the punch member 120A were less than 120AR, the value of WA would be correspondingly smaller. Accordingly, it is believed that in that case a smaller width of the panel 105 would stretch across the side SA of the punch member 120A, inducing a larger amount of strain in this portion of the panel. If the value of the radius of curvature is sufficiently small and the length of the side SA sufficiently large, witness marks are formed.

The fact that the value of WA would be smaller may be understood by reference to the enlarged view of the edge 120AF of punch 120 shown inset at I in FIG. 3(*a*). Edge 120AF shown at I in FIG. 3(*a*) is of larger radius of curvature than edge 120AF', both edges joining side SA and upper surface UA of punch 120A.

It is believed that, in a method according to an embodiment of the present invention, the amount by which material must be strained in order to form the first shapeform and then the second shapeform is such that the amount of tensile strain induced in any given portion of the panel is less than that which is required to induce the formation of visible witness marks. It is to be understood that strain induced in the panel is distributed over a larger area of the panel, and therefore the peak value of strain induced at any given location in the panel is lower than the peak value that would be induced of the blank panel 105 were subjected to only single pressing operation in the second press portion 100B only, and not a dual pressing operation in which the blank panel 105 is pressed in the first press portion 100A and subsequently in the second press portion 100B.

In one particular example of bonnet geometry, it has been found that in order to form a feature line having a radius of around 8 mm, it is advantageous to first draw the panel to form a feature line having a radius of around 35 mm, and subsequently to bend and/or draw the panel to form a feature line having a radius of 8 mm. Other arrangements are also useful.

In some embodiments, more than two press operations may be performed, each press operation reducing the radius of the feature line formed, until a feature line of the desired radius is formed. Other arrangements are also useful.

It is to be understood that feature lines may be formed to have more than one radius of curvature along a length thereof. The radius of curvature may be blended from one value to another value along at least a portion of a length of a feature line. In some embodiments a feature line may be formed that curves along a length thereof. The feature line may define a styling contour of a motor vehicle body shell.

It is to be understood that although FIG. 2 shows a press having two press portions, in some embodiments a single press is employed, having two sets of upper and lower dies (or two upper dies and two punch members). A first upper die and a first lower die (or a first upper die and a punch member) may be used to form the material into the first shapeform. The first upper die may then be replaced by a second upper die and the first lower die replaced by a second lower die (or a first punch member replaced by a second punch member). The second upper die and second lower die or second punch member may then be employed to form the first shapeform into the second shapeform.

In some embodiments the upper die is substantially fixed and the lower die or punch member moves with respect to the upper die. In some alternative embodiments the lower die or punch member is substantially fixed whilst the upper die moves with respect to the lower die or punch member. In some embodiments each component is moved towards the other.

Figure 5:
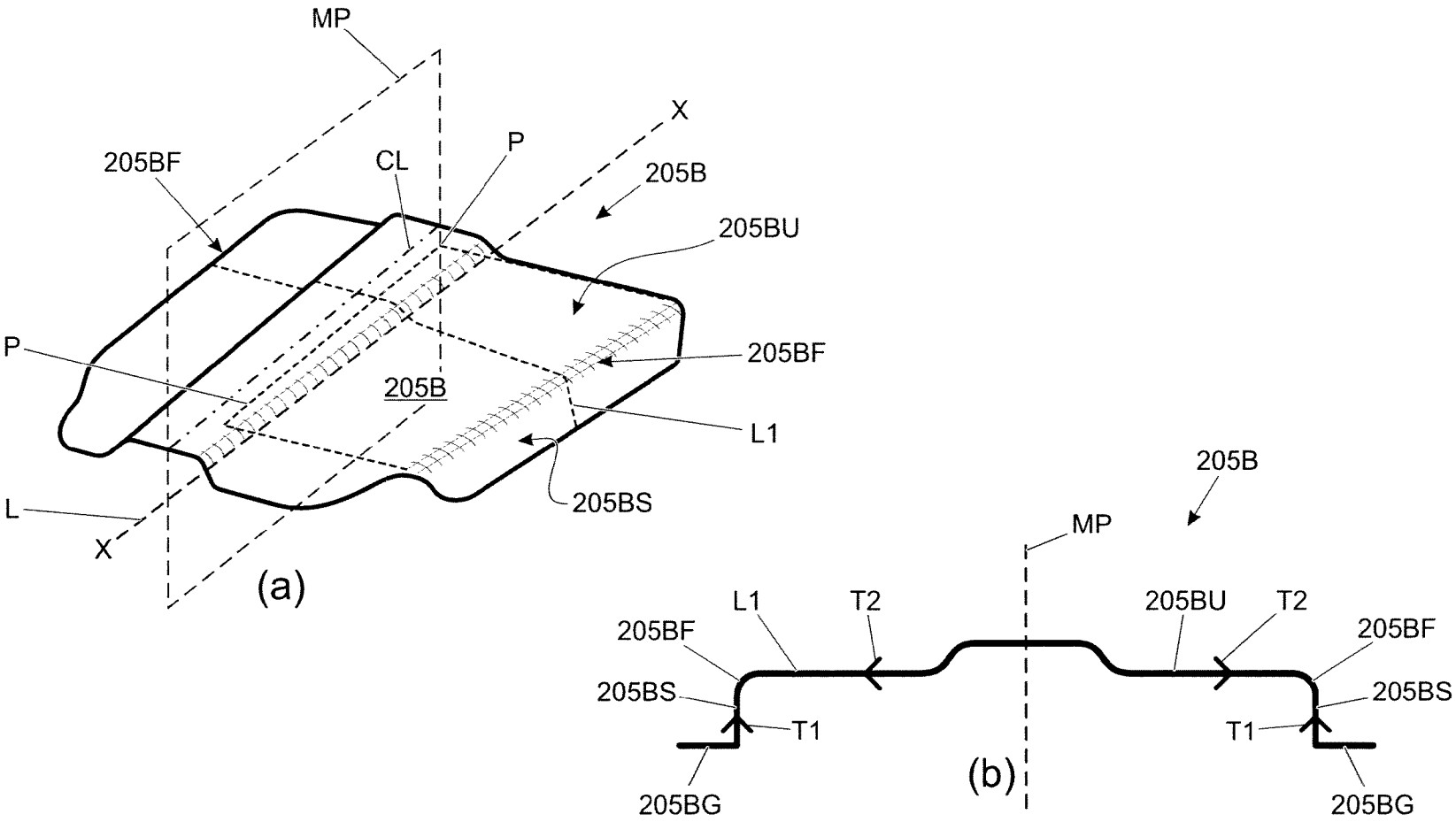
FIG. 5 shows (a) a motor vehicle bonnet of clamshell-type formed by a method according to an embodiment of the invention and (b) a cross-sectional view of the bonnet of (a) along line L1 prior to removal of clamping portions.

FIG. 5(*a*) is a perspective view of a motor vehicle bonnet 205B in final pressed form, the bonnet 205B being formed from a panel 205B that has been subject to a double strike press operation according to an embodiment of the present invention. FIG. 5(*b*) is a corresponding cross-sectional view along line L1 of FIG. 5(*a*) prior to the cutting off of remaining clamping portions 205BG.

The bonnet 205B is of clamshell-type, having an upper portion 205BU that is arranged in use to be disposed generally transversely across a width of a vehicle and side skirt portions 205BS arranged to depend from the upper portion 205BU. It is desirable in some vehicles for the fold line or feature line 205BF defining a junction between the upper portion 205BU and skirt portions 205BS of the clamshell-type bonnet 205B to be of relatively small radius of curvature, in some designs around 8 mm or less.

In the embodiment shown, the bonnet 205B is arranged to be substantially symmetrical in shapeform about a centreline CL thereof. It is to be understood that the bonnet 205B may have one or more features such as one or more air intakes or other features that are not symmetrically disposed about the centreline CL. However, the features lines 205BF are disposed symmetrically about the centreline CL. It is to be understood that the bonnet 205B may be considered to exhibit mirror symmetry about a nominal substantially vertical mirror plane coincident with the centreline CL and shown at MP in FIG. 5. Reference to an orientation herein such as a vertical orientation is to be understood to be reference to an orientation with a component in a normal in-use orientation, in the present example with the bonnet 205B installed in a vehicle and in a closed position.

With reference to the panel 205B shown in FIG. 5, it is to be understood that when the panel 205B is being pressed between the upper die member 110A and punch member 120A with clamping portions 205BG gripped between an upper die member and holder, opposed tensile stresses T1 and T2 will be established on each side of the mirror plane MP and disposed substantially symmetrically about the mirror plane MP. The arrangement of the stresses is shown schematically in FIG. 5(*b*).

The first press operation may comprise forming a pair of feature lines that are disposed such that projections of at least a portion of each feature line onto a nominal flat plane disposed between the feature lines overlap one another, such that during a press operation portions of the panel disposed between the feature lines and on opposite sides of the nominal flat plane are subject to drawing in opposite directions within the plane of the panel. The projections may be substantially superimposed on one another, optionally along substantially an entire length of each projection. In the embodiment illustrated in FIG. 5, the projection of feature lines 205BF onto mirror plane MP is shown by dot-dashed line P, the projections being directly superimposed on one another. It is to be understood that by projection is meant a projection along a direction from the feature line that is normal to the nominal flat plane.

Figure 6:
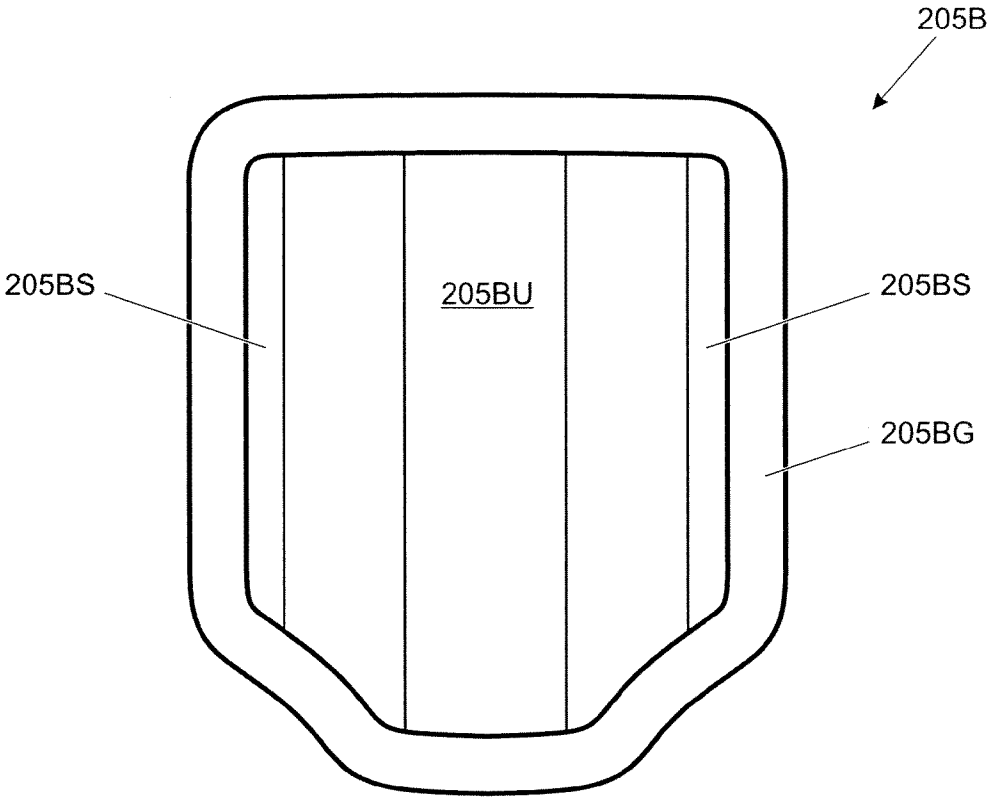
FIG. 6 is a plan view schematic illustration of a panel formed by a method according to an embodiment of the present invention following a second pressing operation and prior to removal of clamping portions thereof.

FIG. 6 shows the panel 205B in plan view following the second press operation prior to cutting of the panel 205B to remove the clamping portions 205BG. It can be seen from FIG. 6 that the clamping portions 205B define a peripheral region of the panel 205B and surround the portion of the panel 205B that forms the final bonnet component of a motor vehicle. It is to be understood that in addition to removal of the clamping portions 205BG, further portions of the panel 205B may be removed following the second press operation in order to produce a component suitable for installation in a motor vehicle.

Embodiments of the invention may also be understood by reference to the following numbered paragraphs:

1. A method for forming a feature line in a motor vehicle body panel comprising:
   - in a first press operation, forming the panel into a first shapeform, the first shapeform having at least one feature line having a first radius of curvature; and
   - in a second press operation, forming the panel into a second shapeform in which the at least one feature line has a second radius of curvature lower than the first.
2. A method as described in paragraph 1 whereby the first press operation comprises gripping a peripheral region of the panel and drawing the panel into the first shapeform by means of a first press operation first press member.
3. A method as described in paragraph 2 whereby the second press operation comprises gripping the peripheral region of the panel and drawing the panel into the second shapeform by means of a second press operation first press member.
4. A method as described in paragraph 2 whereby gripping the peripheral region comprises gripping a substantially continuous region around substantially the entire periphery of the panel.
5. A method as described in paragraph 2 whereby the first press operation comprises pressing the panel against a first press operation second press member by means of the first press operation first press member to form the panel into the first shapeform.
6. A method as described in paragraph 5 whereby the second press operation comprises gripping the peripheral region of the panel and drawing the panel into the second shapeform by pressing the panel against a second press operation second press member by means of a second press operation first press member to form the panel into the second shapeform.

7. A method as described in paragraph 2 whereby the first press operation first press member has a shape corresponding to that of the first shapeform.

8. A method as described in paragraph 5 whereby the first press operation first press member has a shape corresponding to that of the first shapeform and the first press operation first and second press members are of corresponding complementary shape to the first shapeform.

9. A method as described in paragraph 3 whereby the second press operation first press member has a shape corresponding to that of the second shapeform.

10. A method as described in paragraph 9 whereby the second press operation first and second press members are of corresponding complementary shape to the second shapeform.

11. A method as described in paragraph 1 comprising forming a plurality of feature lines in a panel.

12. A method as described in paragraph 12 comprising forming a plurality of substantially parallel feature lines in the panel.

13. A method as described in paragraph 11 comprising forming the feature lines inboard of substantially opposite edges of a panel.

14. A method as described in paragraph 11 comprising forming the feature lines inboard of substantially opposite edges of the panel to define a skirt portion of a clamshell-type vehicle body panel.

15. A method as described in paragraph 1 comprising forming a hood or bonnet of a motor vehicle.

16. A method as described in paragraph 15 comprising forming a bonnet or hood substantially of clamshell-type.

17. A method as described in paragraph 1 comprising forming the first shapeform whereby the first radius of curvature has a value in the range from around 20 mm to around 40 mm, optionally from around 25 mm to around 40 mm, further optionally from around 25 mm to around 35 mm.

18. A method as described in paragraph 1 comprising forming the second shapeform whereby the second radius of curvature has a value from around 1 mm to around 15 mm, optionally from around 5 mm to around 15 mm, further optionally from around 5 mm to around 10 mm.

19. A method as described in paragraph 1 comprising forming the panel from a sheet of metal comprising aluminium, optionally a sheet of 6xxx series or AC-170 aluminium alloy.

20. A method as described in paragraph 1 comprising forming the panel from a sheet of metal having a thickness in the range from around 0.5 mm to around 5 mm, optionally from around 0.5 mm to around 3 mm, further optionally from around 1 mm to around 2 mm, still further optionally around 1.1 mm.

21. A panel formed by a method according to paragraph 1.

22. A motor vehicle comprising a panel according to paragraph 21.

23. An apparatus for forming a feature line in a motor vehicle panel comprising:

a first press portion for performing a first press operation in which a panel is formed by means of a first member of the first press portion into a first shapeform having at least one feature line having a first radius of curvature; and a second press portion for performing a second press operation in which a panel is formed by means of a first member of the second press portion into a second shapeform in which the at least one feature line has a second radius of curvature lower than the first.

24. An apparatus as described in paragraph 23 operable to grip a substantially continuous region around substantially an entire peripheral region of a panel, the first member of the first press portion being operable to draw a panel into the first shapeform and the second member of the second press portion being operable to draw a panel into the second shapeform.

25. An apparatus as described in paragraph 23 wherein the first member of the first press portion has a shape corresponding to that of the first shapeform.

26. An apparatus as described in paragraph 23 wherein the first member of the first press portion is operable to press a panel against a second member of the first press portion.

27. An apparatus as described in paragraph 26 wherein the first and second members of the first press portion are of corresponding complementary shape to the first shapeform.

28. An apparatus as described in paragraph 23 wherein the first member of the second press portion has a shape corresponding to that of the second shapeform.

29. An apparatus as described in paragraph 23 wherein the first member of the second press portion is operable to press the panel against a second member of the second press portion.

30. An apparatus as described in paragraph 29 wherein the first and second members of the first press portion are of corresponding complementary shape to the second shapeform.

31. An apparatus as described in any paragraph 23 wherein the first and second pairs of press members are shaped to define a vehicle bonnet or hood.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A method for forming a feature line in a motor vehicle body panel comprising:

in a first press operation, forming the panel into a first shapeform by means of at least a first press operation first press member, the first shapeform having at least one feature line having a first radius of curvature; and in a second press operation, forming the panel into a second shapeform by means of at least a second press operation first press member in which the at least one feature line has a second radius of curvature lower than the first;

the first press operation comprises gripping a peripheral region of the panel and drawing the panel into the first shapeform by means of the first press operation first press member;

the second press operation comprises gripping the peripheral region of the panel and drawing the panel into the second shapeform by means of the second press operation first press member; and gripping the peripheral region in said first and second press operations comprises gripping a substantially continuous region around substantially an entire periphery of the panel so as to oppose movement of the peripheral region thereby causing a tensile stress to be induced in the panel as the panel is pressed.

2. A method as claimed in claim 1, wherein the first press operation comprises pressing the panel against a first press operation second press member by means of the first press operation first press member to form the panel into the first shapeform.

3. A method as claimed in claim 2, wherein the second press operation comprises pressing the panel against a second press operation second press member by means of the second press operation first press member to form the panel into the second shapeform.

4. A method as claimed in claim 1, wherein the first press operation first press member has a shape corresponding to that of the first shapeform.

5. A method as claimed in claim 2, wherein the first press operation first press member has a shape corresponding to that of the first shapeform and the first press operation first and second press members are of corresponding complementary shape to the first shapeform.

6. A method as claimed in claim 5, wherein the second press operation first press member has a shape corresponding to that of the second shapeform.

7. A method as claimed in claim 6, wherein the second press operation first and second press members are of corresponding complementary shape to the second shapeform.

8. A method as claimed in claim 1, comprising forming a plurality of feature lines in the panel.

9. A method as claimed in claim 8, comprising forming a plurality of substantially parallel feature lines in the panel.

10. A method as claimed in claim 8, comprising forming the feature lines inboard of substantially opposite edges of the panel.

11. A method as claimed in claim 8, comprising forming the feature lines inboard of substantially opposite edges of the panel to define a skirt portion of a clamshell-type vehicle body panel.

12. A method as claimed in claim 1, wherein the body panel comprises a hood or bonnet of a motor vehicle.

13. A method as claimed in claim 1, wherein the first radius of curvature has a value in the range from around 20 mm to around 40 mm.

14. A method as claimed in claim 1, wherein the second radius of curvature has a value from around 1 mm to around 15 mm.

15. A method as claimed in claim 1, comprising forming the panel from a sheet of metal comprising at least one of aluminium, 6*xxx* series aluminium alloy, or AC-170 aluminium alloy.

16. A method as claimed in claim 1, comprising forming the panel from a sheet of metal having a thickness in a range from around 0.5 mm to around 5 mm.

17. A method as claimed in claim 1, wherein gripping the peripheral region comprises holding the peripheral region in a single orientation that remains the same in the first press operation and in the second press operation.

18. A method as claimed in claim 1, wherein the first press operation first press member does not contact the peripheral region of the panel during the first press operation; and the second press operation first press member does not contact the peripheral region of the panel during the second press operation.

19. A method as claimed in claim 1, comprising cutting away the peripheral region of the panel subsequent to the second press operation.

* * * * *